United States Patent [19]

Bueb et al.

[11] 4,070,817

[45] Jan. 31, 1978

[54] PROCESS FOR TEXTURING SYNTHETIC YARNS

[75] Inventors: Michael Bueb, Opladen; Harry Kubitzek; Arthur Langhans, both of Dormagen; Wolfgang Rellensmann, Zons, Neuss; Wolfram Wagner, Dormagen, all of Germany

[73] Assignee: Bayer Aktiengesellschaft, Leverkusen, Germany

[21] Appl. No.: 646,060

[22] Filed: Jan. 2, 1976

[30] Foreign Application Priority Data

Jan. 4, 1975 Germany ..... 2500229

[51] Int. Cl.[2] ..... D02G 1/16; D02G 1/20

[52] U.S. Cl. ..... 57/157 TS; 57/157 F

[58] Field of Search ..... 57/34 R, 34 B, 34 HS, 57/157 R, 157 S, 157 TS, 153, 157 F

[56] References Cited

U.S. PATENT DOCUMENTS

| | | | |
|---|---|---|---|
| Re. 28,254 | 11/1974 | Buzano | 57/157 F X |
| 3,443,292 | 5/1969 | Davis | 57/157 F |
| 3,583,147 | 6/1971 | Brizzolara et al. | 57/157 TS |
| 3,706,192 | 12/1972 | Leibbrand et al. | 57/157 F |
| 3,772,872 | 11/1973 | Piazza et al. | 57/153 X |
| 3,946,548 | 3/1976 | Hino et al. | 57/157 F |
| 3,973,386 | 8/1976 | Gorrafa | 57/34 HS |
| 3,995,420 | 12/1976 | Ohse et al. | 57/140 R |

*Primary Examiner*—Donald Watkins
*Attorney, Agent, or Firm*—Plumley and Tyner

[57] ABSTRACT

The invention relates to a process for the simultaneous drawing and texturing of synthetic yarns by the false-twist method comprising interlacing the unstretched or partially stretched yarn by means of an interlacing device before entering the texturing zone of the texturing machine.

4 Claims, 2 Drawing Figures

PROCESS FOR TEXTURING SYNTHETIC YARNS

Figure 1:
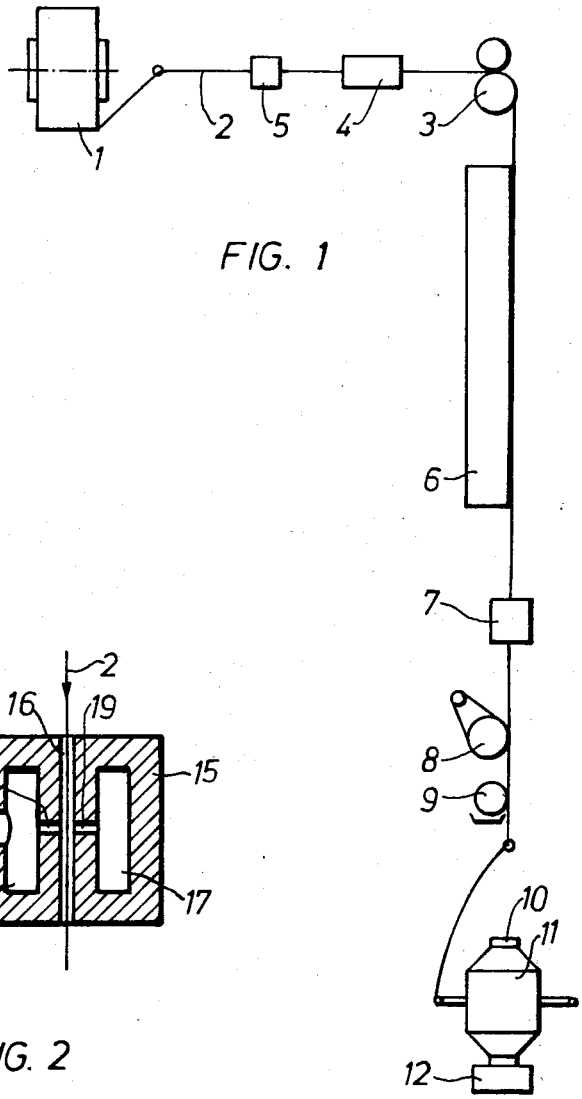

This invention relates to a process for the simultaneous drawing and texturing of thermoplastic synthetic yarns, more especially for the simultaneous drawing and texturing of polyamide yarns.

In simultaneous drawing and texturing processes, a synthetic thermoplastic polyamide yarn or filament-like structure is simultaneously drawn and textured in a single operation. The object of this process is to produce a drawn, crimped and high-bulk yarn from a smooth, unstretched or partially stretched yarn. This result is normally achieved by passing the yarn through delivery rollers into a texturing zone where the yarn is twisted by means of a so-called false-twist unit. This twist is fixed permanently into the yarn by the action of heat on the twisted yarn, the heat coming from a heating bar. After the false-twist unit, the yarn travels over a stretching godet. The yarn is stretched to the required extent between the delivery rollers and the stretching godet. In this way, drawing and texturing can be carried out simultaneously between the delivery rollers and stretching godet.

It is known that certain process parameters have to be strictly observed in order to produce effectively textured and bulky polyamide yarns. For example, the twist applied in the texturing zone has to be sufficiently high. Originally it was preferred to use so-called false-twist spindles as the false-twist units. In modern processes, so-called friction twisters, for example internal friction twisters (sleeves) or external friction twisters (discs), are also used as the false-twist units. Friction twisters enable the process to be carried out at higher speeds, for example at speeds of more than 400 metres per minute. There is extensive Patent literature relating to drawing and texturing processes and to various types of false-twist units, cf. for example U.S. Pat. Nos. 3,069,837; 3,404,525; 3,435,603; 3,094,834; 3,733,801; GB Patent Specifications Nos. 777,625; 1,098,545; 890,053; 815,202; German Offenlegungsschriften Nos. 1,935,389; 1,946,791; 2,049,413; 2,049,357; and German Auslegeschrift Nos. 2,213,147, etc.

Yarns which have been simultaneously drawn and textured are characterised by the fairly pronounced cross-sectional deformations of the individual capillaries. This cross-sectional deformation differs in regard to its geometry and extent according to whether the individual capillaries lay on the outside or inside of the yarn assemblage during stretching and deformation. One particular disadvantage is that those individual capillaries situated in or near the central yarn axis during stretching and deformation are inadequately deformed or poorly textured. This effect is particularly pronounced in the case of relatively coarse deniers and relatively high capillary counts, for example in a 12-filament yarn of 55 dtex.

The result of this is that the final yarn contains individual poorly textured or smooth individual capillaries which normally have a length of the order of from 5 to 30 mm. These individual capillaries may stand out from the yarn assemblage and become visible for example in the form of so-called loops. Disadvantageous consequences of this loop formation, are, for example, poor knittability on hosiery machines and spoiling of the stitch pattern of the sheet-form textile article produced.

Accordingly, an object of the present invention is to improve the process for simultaneous drawing and texturing to the extent that it is possible to produce a yarn which only contains few, if any, poorly textured individual capillaries (loops).

According to the invention, this object is achieved by virtue of the fact that, before entering the delivery rollers of the texturing machine, i.e., just before the drawing and texturing process, the unstretched or partially stretched yarn is interlaced by means of an interlacing device in order to interlace the individual capillaries with one another to the required extent. In this way, so-called filament migration is surprisingly increased to such an extent that the poorly textured individual capillaries (loops) otherwise normally encountered no longer occur.

The present invention relates to a process for the simultaneous drawing and texturing of synthetic yarns by the false-twist method comprising interlacing the unstretched or partially stretched yarn by means of an interlacing device before entering the texturing zone of the texturing machine.

Yarn speeds of from 300 to 1000 metres per minute are generally maintained during texturing. The yarn deniers are preferably in the range of from 20 to 200 dtex. The stretching ratio in the drawing and texturing zone is adjusted to values of generally from 1 : 2.5 to 1 : 4 by coordinating the delivery and take off speeds. The yarn temperatures are kept at preferably 140° to 200° C by conventional heating means.

In one preferred embodiment of the invention, the unstretched or partially stretched yarn is subjected to interlacing shortly after leaving the spinning duct in such a way that it is optimally prepared for the subsequent drawing and texturing process in so far as it is free from untextured individual capillaries (loops).

Suitable interlacing devices are described, for example, in U.S. Pat. Nos. 2,985,995; 3,069,836 and 3,110,151. The yarn tension prevailing during the interlacing operation generally amounts to between 0.5 and 5 p. In order to maintain this tension, the yarn is guided through a yarn break which is arranged upstream of the interlacing device in the path followed by the yarn.

The number of entanglements preferably amounts to between 100 and 1000 entanglements per metre so that the object of the invention can be achieved. At least 300 entanglements per meter are preferably produced in the yarn.

The particular advantages of the invention are that the quality of the simultaneously drawn and textured yarns can be considerably improved through the avoidance of the untextured individual capillaries (loops) normally encountered.

One possible embodiment of the invention is illustrated in the drawing and described in detail in the following.

FIG. 1 is a flow chart of a simultaneous drawing and texturing process. The unstretched or partially stretched yarn 2 is run off from the package 1 by means of the delivery rollers 3. The delivery rollers 3 are preceded by the interlacing device 4. The interlacing device consists, for example, of an air interlacing nozzle. In order to be able to adjust the yarn tension in the vicinity of the interlacing device, a conventional yarn break 5 is arranged upstream of the interlacing device 4 in the path followed by the yarn. After passing through the delivery rollers 3, the yarn travels over a heating bar 6. The false-twist unit 7 twists the yarn in the texturing zone. After leaving the false-twist unit, the yarn travels over a stretching godet 8. It is then wound, for example on a tube 10, into a cop 11 by means of a winding spindle 12. The yarn may optionally be re-oiled at a re-oiling stage 9 before being wound up. In some processes, the yarn travels through a second heating zone after the stretching godet 8.

Yarns which have been interlaced by means of an interlacing device in the manner described before entering the texturing zone give rise to textured yarns which have hardly any poorly textured individual capillaries (loops).

Figure 2:
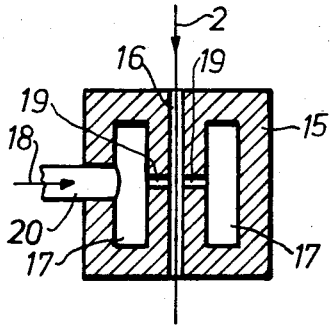

FIG. 2 illustrates one exemplary embodiment of an interlacing device of the kind in question. A housing 15 is formed with a bore 16 through which the yarn 2 travels. Air is supplied to the nozzel bores 19 through an annular channel 17. The air 18 is delivered to the interlacing nozzle through the pipe 20. The air issues from the nozzle bores 19 into the bore 16 where it produces intensive interlacing of the individual capillaries of the yarn 2.

In the case of filament-like structures which are interlaced, it is common practice to define the interlacing effect numerically by expressing the number of entanglements or knots per meter.

The interval between the entanglements can be measured by introducing a needle transversely of the yarn axis between the individual capillaries of the yarn and sliding it along the yarn axis until a resistance to the movement of the needle indicates the presence of a entanglement or knot.

In the present case, this type of measurement is difficult to carry out because the yarn in question is unstretched, i.e., unstretchable yarn. In addition, it is emphasised that it is not the object of the invention to produce entanglements atcertain intervals, but instead to interlace or geometrically to offset the individual capillaries relative to one another in a substantially continuous sequence so that, during texturing, the individual capillaries in the twisted yarn change their geometric positions relative to one another at the shortest possible intervals.

Accordingly, the result of interlacing can only be approximately defined by quoting a number of entanglements per metre of yarn length. For example, this number may be assessed by observing the interlaced yarn under a microscope.

Further development of the invention has surprisingly shown that yarns which have been treated with an interlacing device after leaving the spinning duct and before being wound into package form, also give rise during simultaneous drawing and texturing to textured yarns which contain hardly any poorly textured individual capillaries (loops).

The following examples are to further illustrate the invention without limiting.

EXAMPLE 1

A 2-filament polyamide 6 yarn of 55 dtex is textured at a rate of 500 meters per minute by simultaneous drawing and texturing. The false-twist unit is an internal friction twister. The heating bar in the drawing and texturing zone has a temperature of 155° C. The stretching ratio is 1 : 3.1. An air interlacing nozzle is used as the interlacing device. The air pressure before this nozzle amounts to 2.5 atms gauge. The nozzle bores have a diameter of 1 mm. After leaving the interlacing nozzle, the unstretched yarn contains approximately 300 entanglements per metre. An effectively textured yarn free from poorly textured individual capillaries (loops) is formed.

EXAMPLE 2

A 12-filament polyamide 6 yarn of 55 dtex is textured at a rate of 500 meters per minute by simultaneous drawing and texturing. The false-twist unit is an internal friction twister. The heating bar in the drawing and texturing zone has a temperature of 155° C. The stretching ratio is 1 : 3.1. Shortly after leaving the spinning duct, the yarn is treated with an interlacing device consisting of an air interlacing nozzle. The nozzle bores have a diameter of 1 mm. The air pressure in front of the nozzle amounts to 3 atms gauge. After leaving the interlacing nozzle, the unstretched yarn contains approximately 100 entanglements per meter. An effectively textured yarn free from poorly textured individual capillaries (loops) is formed.

What we claim is:

1. A process for treating synthetic yarns which have been stretched in stretching ratios of from 1:2.5 to 1:4 which comprises interlacing such yarn followed by simultaneously drawing and texturing the yarn by simultaneously drawing and texturing the yarn by false-twisting at a temperature of from 140° to 200° C.

2. A process as claimed in claim 1 wherein the stretched yarn is interlaced by means of an air interlacing nozzle at the end of the spinning duct before being wound up.

3. A process as claimed in claim 1 wherein the yarn is interlaced to a level of from 100 to 1000 entanglements per meter.

4. A process as claimed in claim 1 wherein the yarn is interlaced by an air interlacing nozzle.

* * * * *